United States Patent [19]

Knobel et al.

[11] 4,136,784

[45] Jan. 30, 1979

[54] SCARF HANGER

[76] Inventors: Gladys Knobel, 340 Greenbay Rd., Glencoe, Ill. 60022; Theodore Prisland, 632 Melody La., Highland Park, Ill. 60035

[21] Appl. No.: 853,129

[22] Filed: Nov. 21, 1977 (Under 37 CFR 1.47)

[51] Int. Cl.[2] ..... A47F 5/01

[52] U.S. Cl. ..... 211/119; D6/251

[58] Field of Search ..... 211/119, 106; 248/302; 223/85; D6/247, 251, 256

[56] References Cited

U.S. PATENT DOCUMENTS

| | | | |
|---|---|---|---|
| 1,087,067 | 2/1914 | Loudenslager | 211/119 X |
| 1,929,284 | 3/1933 | Misbach | 223/85 |
| 2,468,526 | 4/1949 | Tusay | 211/119 X |
| 3,194,457 | 7/1965 | Freilich | D6/251 UX |
| 3,887,079 | 6/1975 | Crew | 211/119 X |

OTHER PUBLICATIONS

"Display World", Jun. 1958, pp. 84 and 91.
Handy Man's Home Manual, 1935, p. 38.

*Primary Examiner*—Roy D. Frazier
*Assistant Examiner*—Robert W. Gibson, Jr.
*Attorney, Agent, or Firm*—Jack E. Dominik

[57] ABSTRACT

A hanger for scarfs and other suspendable fabric products is disclosed in which the scarfs are positioned in various rings and are separated from each other for viewing or display. They further can be removed without interfering with the positioning of adjacent scarfs. There is a hanging element at the upper portion of the hanger and a plurality of rings below the hanging element through which the scarfs are positioned. The positions and weight of the rings maintains the hanger in an essentially vertical plane regardless of the positioning of the scarfs.

7 Claims, 4 Drawing Figures

SCARF HANGER

BACKGROUND OF THE INVENTION

1. Field of the Invention

The present invention relates to an apparatus for hanging scarfs or like fabric materials. The subject matter of hangers is generally found in Patent Office Classes 211 and 223.

2. The Prior Art

The prior art has been directed towards various hanger configurations, mostly for use in the displaying of a product. Quite often the hangers have removable portions such as illustrated in U.S. Pat. No. 3,463,324 to Schaefer. Other hangers using a clamping means to retain a fabric are illustrated in U.S. Pat. Nos. 3,350,754 and 2,905,369. Most often the prior art has dealt with commercial displays of fabrics, and not been concerned with easy insertion or removal of numerous scarfs or fabric pieces without disturbing adjacent pieces.

SUMMARY OF THE INVENTION

The present invention relates to hangers, particularly for use in hanging scarfs or other like suspendable fabrics. The invention is directed to a construction of a hanger which utilizes a plurality of rings beneath a hanging element and attached to it. The rings, through which the scarf or fabric material is placed, are positioned in such a manner as to add stability and create a statically belanced condition. This is accomplished by positioning lateral rings at extreme outer positions relative to the hanger and beneath the hanging element. Other rings are positioned essentially at equal distances from a vertical axis drawn between the lateral rings. The weight of the hanger and rings holds the hanger in essentially a vertical plane regardless of the positioning of the relatively light scarfs or fabrics hung therefrom.

The hanger itself can be formed of two members for ease of construction. Likewise, the overall size and number of rings can be changed to accommodate various numbers of scarfs. The hanger itself is generally manufactured from a metallic wire which is then painted or further finished to produce an aesthetically pleasing and non-staining or rusting finish.

Accordingly, it is a principal object of the present invention to provide a hanger for use in displaying or storing scarfs or other fabric like materials which will allow easy insertion or removal of the fabric without disturbing adjacent fabrics.

Furthermore, it is an object to produce a hanger which is statically balanced whether there are scarfs or fabrics being supported from it or not.

A further object of the invention is to provide a scarf hanger having a finish such that it will not damage or harm by catching, snagging, rusting, or otherwise interacting with the scarfs.

DESCRIPTION OF THE DRAWINGS

Further objects and advantages of the present invention will become apparent as the following description of a scarf hanger proceeds, taken in conjunction with the accompanying drawings in which.

DETAILED DESCRIPTION OF THE INVENTION

Figure 1:
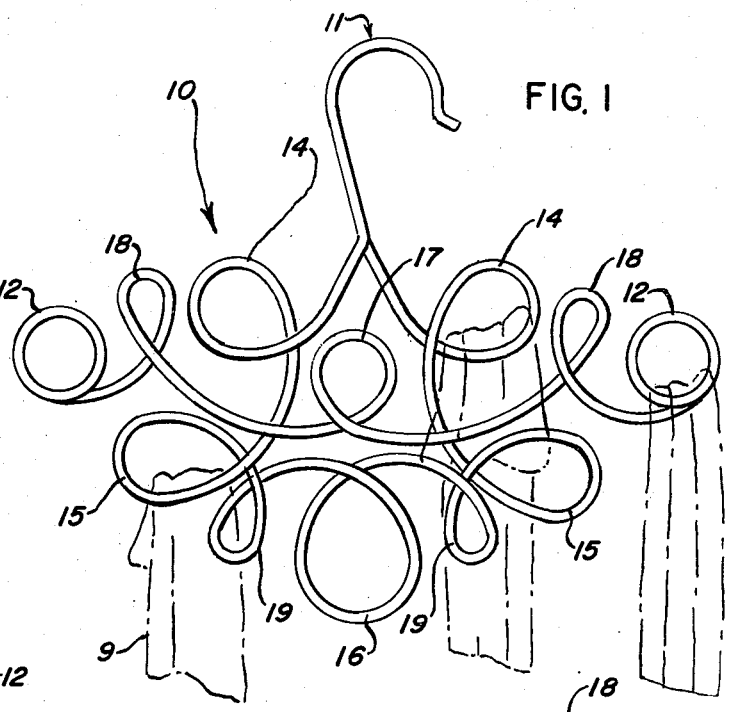
FIG. 1 is a front view of the scarf hanger, with scarfs supported therefrom in phantom.

Turning first to FIG. 1 there is shown a scarf hanger 10 illustrative of the present invention. An arcuate hanging portion 11 is positioned at what is intended to be the upper portion of the hanger. The curvature of the hanging portion 11 is designed to fit over a closet bar or rod so as to not be easily dislodged therefrom unless intentionally lifted over the rod for removal purposes.

Figure 2:
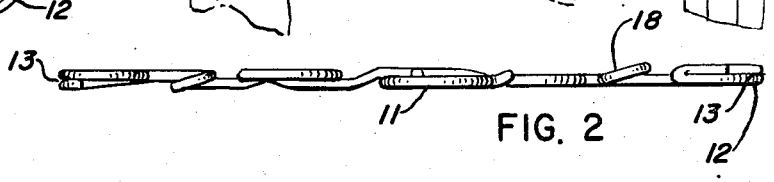
FIG. 2 is a top view of the scarf hanger of FIG. 1.

Beneath the hanging portion 11 is a plurality of rings from which the scarfs are hung. There are two lateral rings 12 positioned at the outermost extremities lateral to the hanger 10 and beneath the hanging portion 11. Inasmuch as the lateral rings 12 are formed from metal wire, the closed portion of the ring 12 is created from the wire being bent around upon itself and fastened at a junction 13. This is more clearly viewed in FIG. 2. The junction 13 can be welded or joined in any one of a number of other means such as the utilization of various adhesives. The important consideration is that the end of the wire not come loose from the junction 13.

There are two top major rings 14 and two lower major rings 15 central to the outermost lateral rings 12. The top major rings 14 and lower major rings 15 are positioned relative to each other at substantially the same distance from a vertical axis drawn through the center of the hanger 10 and perpendicular to a horizontal axis between the central portion of the lateral rings.

There is one bottom ring 16 positioned at the lowermost portion of the hanger, and the line drawn vertically through the center of the hanger essentially divides this bottom ring 16 in half. Located above the bottom ring 16 is a center ring 17, also divided by the vertical line passing through the center of the scarf hanger 10. All of the rings 12, 14, 15, 16, and 17 present loops through which scarfs or related materials can be draped as illustrated by scarfs 9 drawn in phantom in FIG. 1. There are lateral minor rings 18 and lower minor rings 19 which add structural stability and weight to add static stability to the scarf hanger 10. The lateral minor rings 18 are also positioned equidistant from a vertical line passing through the center of the scarf hanger, just as the lower minor rings 19 are positioned. The minor rings 18, 19 could be utilized to receive scarfs or fabric providing that the bulk of the fabric to be passed through the ring is not prohibitive.

Figure 3:
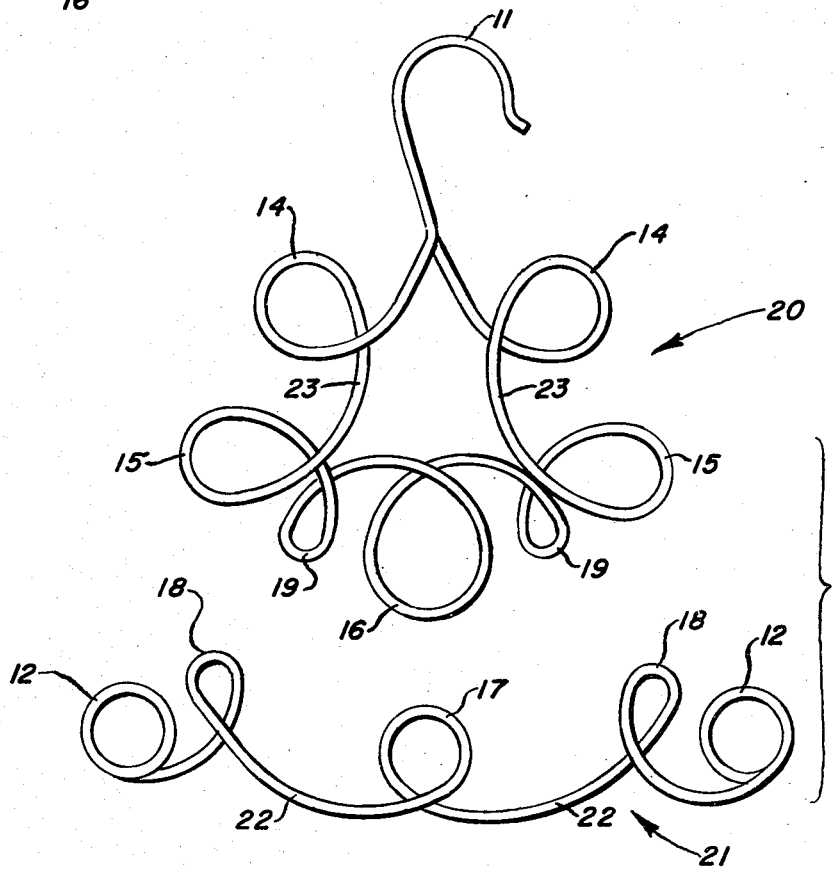
FIG. 3 is an exploded front view of two pieces used to manufacture the scarf hanger as shown in FIG. 1.

FIG. 3 illustrates the preferred method of manufacturing the hanger 10. There is a main body 20 which comprises the top major rings 14, lower major rings 15, lower minor rings 19, and bottom ring 16. There is also illustrated a main body connecting junction 23 between the top major rings 14 and lower major rings 15. A crossbar 21 comprised of the lateral rings 12, lateral minor rings 18, and center ring 17 is also illustrated. Crossbar connecting junctions 22 are positioned between the center ring 17 and lateral minor rings 18. After main body 20 and crossbar 21 are manufactured, the two pieces are joined by placing the crossbar 21 on main body 20 such that the crossbar junction 22 is aligned and makes contact with the main body junction 23. The positioning is such that the center ring 17 is centered above bottom ring 16. At the junction points, the two pieces are preferably welded together. Once again, alternative fastening means such as adhesives might be used.

Figure 4:
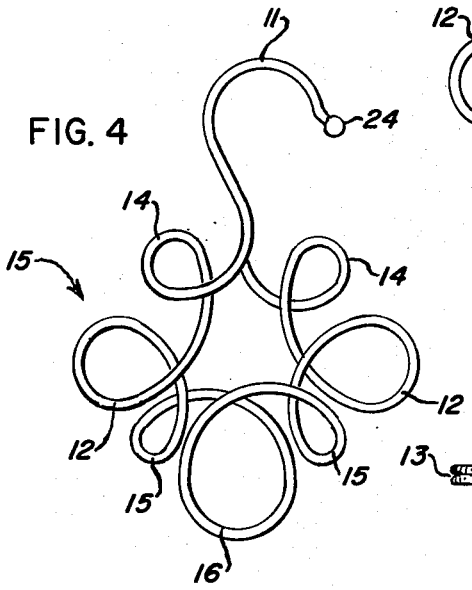
FIG. 4 is a front view of an alternative embodiment smaller scarf hanger.

A smaller scarf hanger 25 embodying the present invention is illustrated in FIG. 4. One difference between this hanger and that shown in FIG. 1 is that it is constructed of one piece of wire, whereas that shown in FIG. 1 is preferably manufactured of two pieces. Also, a terminating knob 24 is shown at the end of the hanging portion 11 to prevent accidental injury to the user from any sharp or pointed ends formed during manufacturing.

Various materials can be utilized in the manufacture of the scarf hanger 10 disclosed. It has been found that bright basic steel wire of approximately ⅛" in diameter results in a hanger having sufficient weight for static stability, strength to retain its rigid configuration, and flexible enough to be formed into the looping configuration. It is preferable to weld all points where the wire overlaps upon itself in addition to where the main body 20 and crossbar 21 are joined. This results in additional stability and rigidity in the structure.

As the number of loops is increased, one can readily appreciate the increased difficulty in manufacturing the hanger from one piece of metal. Applicants approach in manufacturing the scarf hanger 10 is illustrated above wherein the two pieces, main body 20 and crossbar 21 are welded together.

The completed hangers can then be painted by spraying, dipping, or other painting methods. A problem encountered in painting is the resultant hangers have a tendency to allow the paint to chip. A baked enamel finish has the same disadvantageous result. To alleviate these problems a method by which the hanger is washed, primed, heated and dipped into a powder in a fluidized bed, baked, then removed and allowed to cool is employed. A flexible, sufficiently thick, stain-resistant coating results. This alleviates any problems of the hanger rusting and then staining the fabrics hanging from it.

Thus, it is apparent that there has been provided, in accordance with the invention, a scarf hanger that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A hanger for scarfs and like suspendable fabric products comprising, in combination, a hanging element at the upper intended portion of the hanger, a plurality of rings beneath the hanger and coupled directly thereto, two lateral rings positioned at extremes lateral to the hanger and beneath the hanging element, two top and two bottom rings central of the lateral rings and in essentially flanking relationship to a horizontal axis between the central portion of the lateral rings, one ring positioned below the hanger, the major portion of which is below the axis between the centers of the two bottom rings, said hanger being formed from two bent wire portions, said first bent wire portion including the hanging element, the two top rings, the two bottom rings, and the ring positioned below the hanger, a second separate element comprising the lateral two rings at the remote portions thereof, the same being proportioned to overlie and being connected between the centers of the two top rings and two bottom rings, whereby upon hanging the subject hanger for scarfs on the hanging element, the weight of the aforesaid recited rings is therebeneath and holds the same in an essentially vertical plane, and whereby when scarfs or like suspendable fabric elements are positioned in the various rings as identified hereinabove, a static balance is created, and the scarfs and like suspendable fabric products are separated each from the other suitable for insertion and removal without interfering with the positioning of the remaining scarfs or the like suspendable fabric products.

2. In the hanger for scarfs and like suspendable fabric products as set forth in claim 1 above, wherein said second separate element further includes a central ring positioned midway between said lateral rings.

3. In the hanger for scarfs and like suspendable fabric products as set forth in claim 2 above, wherein said second separate element further includes dimensionally smaller rings positioned between said lateral rings and central ring.

4. A hanger for scarfs and like suspendable fabric products comprising, in combination, a wire section having a hanging element thereatop, and depending therefrom, bent portions defining in looplike configuration two upper rings and two lower rings, and a bottom ring positioned essentially directly beneath the hanger and beneath the lower bottom rings, and a second bent wire member characterized by two closed rings at the remote end portions thereof, and a wire member continuous therebetween for positioning between the upper aforesaid rings and the lower aforesaid rings of said hanger element, the same being secured by welding or related processes to said wire section to define a hanger for scarfs and like suspendable fabric products having at least seven suspension rings.

5. In the hanger for scarfs and like suspendable fabric products as set forth in claim 4 above, said second bent wire member having a curvilinear closed loop at the central portion thereof and proportioned for positioning substantially axially between the effective axis of the hanger, and the effective axis of the lower ring.

6. In the hanger for scarfs and like suspendable fabric products as set forth in claim 4 above, wherein said second bent wire member further includes a central ring positioned midway between said outer rings.

7. In the hanger for scarfs and like suspendable fabric products as set forth in claim 6 above, wherein said second bent wire member further includes dimensionally smaller rings positioned between said outer rings and central ring.

* * * * *